United States Patent [19]

Francovitch

[11] Patent Number: 4,476,660

[45] Date of Patent: Oct. 16, 1984

[54] MEMBRANE ANCHOR WITH FLEXURE RESISTING REGIONS

[76] Inventor: Thomas F. Francovitch, 6373 Windharp Way, Columbia, Md. 21045

[21] Appl. No.: 417,110

[22] Filed: Sep. 9, 1982

[51] Int. Cl.[3] ..... E04B 1/62; F16B 29/00; E04D 3/36

[52] U.S. Cl. ..... 52/515; 52/467; 52/512; 405/259; 411/542

[58] Field of Search ..... 52/506, 509, 512, 515, 52/309.2, 459, 463, 464, 467, 468, 520, 543, 582; 411/544, 545, 542, 154–156; 405/259

[56] References Cited

U.S. PATENT DOCUMENTS

| | | | |
|---|---|---|---|
| 1,111,034 | 9/1914 | Robertson | 411/531 X |
| 1,573,961 | 2/1926 | Zucker | 411/546 X |
| 2,020,767 | 11/1935 | Bullis et al. | 411/542 X |
| 3,173,228 | 3/1965 | Roberts | 52/467 X |
| 3,390,713 | 7/1968 | Gutshall | 411/154 |
| 3,398,496 | 8/1968 | Mischke | 52/467 X |
| 3,909,998 | 10/1975 | Simpson et al. | 52/543 |
| 4,026,183 | 5/1977 | Bart | 411/542 |
| 4,037,418 | 7/1977 | Hannan | 405/259 |
| 4,067,155 | 1/1978 | Ruff et al. | 52/309.2 |
| 4,361,997 | 12/1982 | DeCaro | 52/512 |

FOREIGN PATENT DOCUMENTS

| | | | |
|---|---|---|---|
| 214120 | 3/1961 | Austria | 52/468 |

*Primary Examiner*—J. Karl Bell

[57] ABSTRACT

A membrane anchor system including a body made of resilient metal comprising a central region with an opening therein, a downwardly sloping region and a peripheral region outwardly of the downwardly sloping region; the downwardly sloping region has radially extending upwardly convex regions therein to resist upward flexure. A linear fastener extends through the body and through the membrane, and mastic is placed between the body and the membrane.

6 Claims, 6 Drawing Figures

Fig. 3.
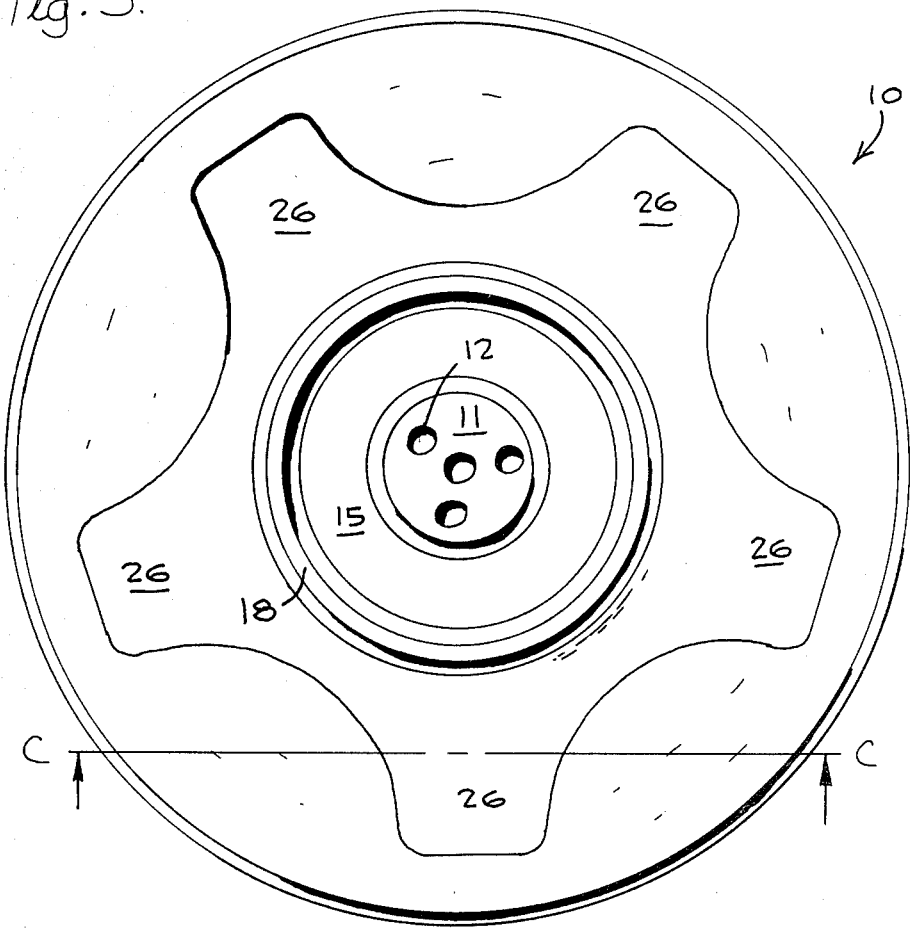
Fig. 4.
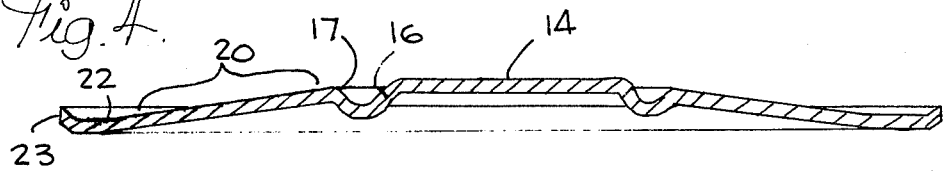
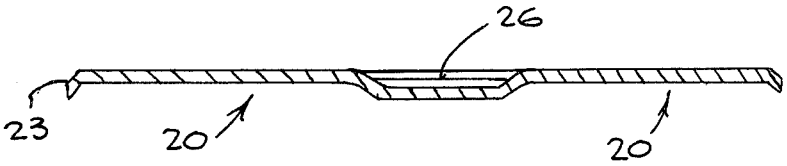
Fig. 5.

MEMBRANE ANCHOR WITH FLEXURE RESISTING REGIONS

TECHNICAL FIELD

The present invention relates to an anchor system for a membrane used as a roofing material to prevent moisture from entering a structure such as a building.

BACKGROUND ART

It is conventional to apply membranes to roofs in order to prevent the entry of moisture into the structure of which the roof forms a part. These membranes are made of synthetic, rubber-like material which is flaccid and waterproof and typically are 3/64" thick; they are supplied in rolls of 100' length and vary in width from 4'6" to 45'.

There have been four systems utilized for fastening the membranes. In the adhered system, a suitable cement is applied to the substructure surface and the rubber-like membrane applied over it; there is an overlap of one membrane sheet with the next, so as to provide a water impervious lap joint. A partially adhered method or system is used, wherein the bonding of the membrane takes place at special plate areas or locations. The ballasted system involves the holding down of the membrane with a layer of small stones. There is also used a mechanically fastened system, in which battens or other strips are placed on the membrane and are adhered, with complex systems for connecting the batten and sealing it. The batten is a strip of rubber, plastic, or metal material and is utilized in order not only to hold the sheet down against wind forces which might tend to lift it (as do the other systems) but also prevents or retards creeping movement of the sheet due to the expansion and contraction. The seal utilized with the batten strip is a small membrane sheet which entirely covers the batten strip and which is glued down over the entire strip. All of the foregoing systems suffered either from expense of installation, or expense of materials, or both.

DISCLOSURE OF THE INVENTION

The present invention is directed to a metal, resilient body for use in the anchoring of a roofing membrane, and to an anchor system utilizing such body. The membrane is of a known construction, being of rubber-like material, and is in the form of a sheet which is applied over a roof substrate. The body is of resilient metal, and is relatively thin in comparison to its lateral extent; preferably, the body is a disc, and has upper and lower surfaces. The body includes a central, substantially planar region having an opening centrally therein, and outwardly of the central region there is provided a downwardly facing cavity which is located above the central region, and surrounds the central region. In surrounding relationship to the cavity is a groove, and in surrounding relationship to the groove is a downwardly and outwardly sloping region which extends to a flexure zone at its outer boundary, there being a peripheral region in surrounding relation to the flexure zone. The downwardly and outwardly sloping region is provided with radially extending, upwardly convex regions which serve to prevent or resist flexure of the downwardly and outwardly sloping region. The body, when in the unstressed condition, has the peripheral region at a level lower than the lower surface of the groove and central region. The downwardly sloping region, including specifically the radially extending, upwardly convex regions therein, defines a mastic overflow space, and has a bending zone inwardly of it, so that when a linear fastener is passed through the opening, mastic applied to the lower surface of the body in the downwardly facing cavity may overflow into the overflow space.

A number of anchoring systems, utilizing the above-noted body, may be provided. One such system includes a membrane which is placed over substrates of the roofing system, with the body placed over the membrane, and a linear fastener is then passed through the opening, so as to stress the body, resulting in the central region, contact region and peripheral region engaging the membrane, with mastic in the cavity over-flow space. Sealant is provided over the head of the fastener, in the recess in the upper surface.

BRIEF DESCRIPTION OF THE DRAWINGS

FIG. 3 is a bottom plan view of the body of FIG. 1.

FIG. 4 is a cross-sectional view taken on the line B—B of FIG. 1, and looking in the direction of the arrows.

FIG. 5 is a cross-sectional view taken on the line C—C of FIG. 3, and looking in the direction of the arrows.

BEST MODE FOR CARRYING OUT THE INVENTION

Figure 1:
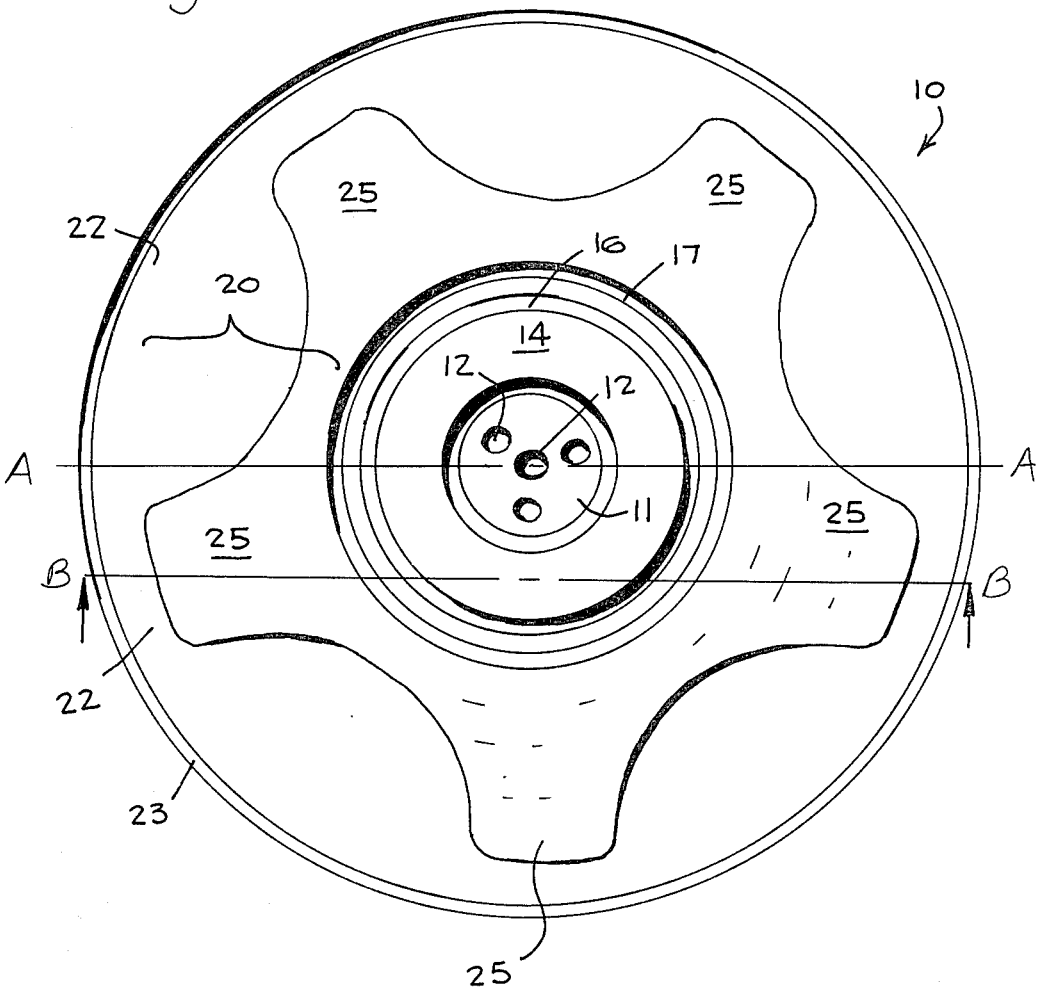
FIG. 1 is a top plan view of a body in accordance with the present invention.
Figure 2:
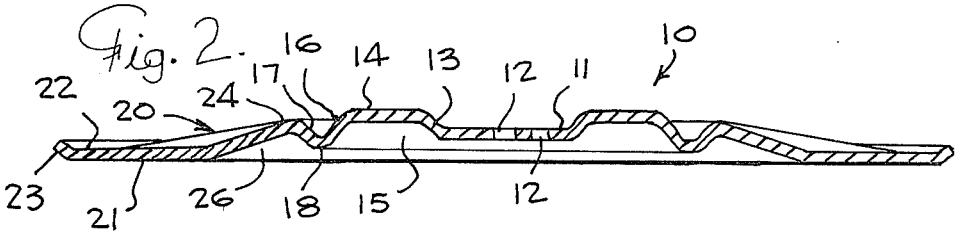
FIG. 2 is a cross-sectional view taken on the line A—A of FIG. 1.

Referring now to the drawings, wherein like or corresponding reference numerals are used to designate like or corresponding parts throughout several views, there is shown in FIGS. 1–5 a body 10 of a suitable material, body 10 being preferably of disc shape, and being relatively thin in comparison to the lateral extent thereof. The body may be made of such materials as plastic, sheet steel or aluminum. The body 10 has an upper surface shown in FIG. 1, and a lower surface shown in FIG. 3. In FIG. 2, the body 10 will be seen to have a central, substantially planar region 11 with openings 12 extending therethrough. A downwardly facing cavity 15 is provided outwardly of and in surrounding relationship to the central region 11, and is defined by an annular portion of the body which is at a level above the level of the central region 11, thereby defining a recess in the upper surface above the central region 11.

More particularly, outwardly of the central region 11 there is an upwardly inclined annular region 13, outwardly of which is an elevated annular region 14. Outwardly of the annular region 14 is a downwardly inclined annular region 16, and there is provided an upwardly inclined annular region 17 outwardly of it. The cavity 15 will seen to be in the space below the regions 13, 14, and 16. The inclined regions 16 and 17 provide, on the bottom surface, an annular contact region 18.

As will be understood, the inclined annular regions 16 and 17 provide an upwardly facing V-shaped groove.

Outwardly of the groove defined by the regions 16 and 17 there is a downwardly sloping region 20, this region extending generally as indicated by the bracket 20 in FIG. 1. At the outer edge of the outwardly and downwardly extending region 20 there is a flexure zone 22, and outwardly of the flexure zone 22 there is an upturned lip 23. In the unstressed state of the body 10, as shown in FIG. 1, there is, on the lower surface of the body 10, a contact zone 21. The contact zone 21 underlies the downwardly sloping region 20, in part, and also partially underlies the flexure zone 22. As will be understood, there is a flexure zone at the inner boundary of the outwardly and downwardly sloping region 20. This flexure or bending zone at the inner boundary of the outwardly and downwardly sloping region 20 is designated 24, and is just outwardly of the inclined region 17. This bending zone 24 will bend upon stressing of the body 10 in a manner to be hereinafter set forth. In the unstressed condition, as shown in FIG. 2, it will be noted that the contact region 18 is slightly below the central region 11, and that the annular region 14, above the cavity 15, is above both the central region 11 and the outer boundary of the inclined region 17.

Referring now to FIG. 1, there will be seen in the outwardly and downwardly inclined region 20 a plurality extending, upwardly convex regions 25, which terminate inwardly of the outer flexure zone 22. They provided for resistance to upward flexing of the region 20, and also provide a space 26 therebeneath, to serve as an overflow space for mastic.

FIG. 3 shows a bottom view of the body 10, with the overflow spaces or cavities 26 therein. There is also shown the bottom surface of the central planar region 11, the holes 12, and the cavity 15. Also shown is the annular contact region 18.

Referring to FIG. 4, there mayb be seen the elevated annular region 14, the inclined regions 16 and 17, the outwardly and downwardly sloping region 20, the outer flexure zone 22 and the upturned peripheral lip 23.

In FIG. 5, there is shown the space or cavity 26, as well as portions of the outwardly and downwardly sloping region 20, and the outer lip 23.

Figure 6:
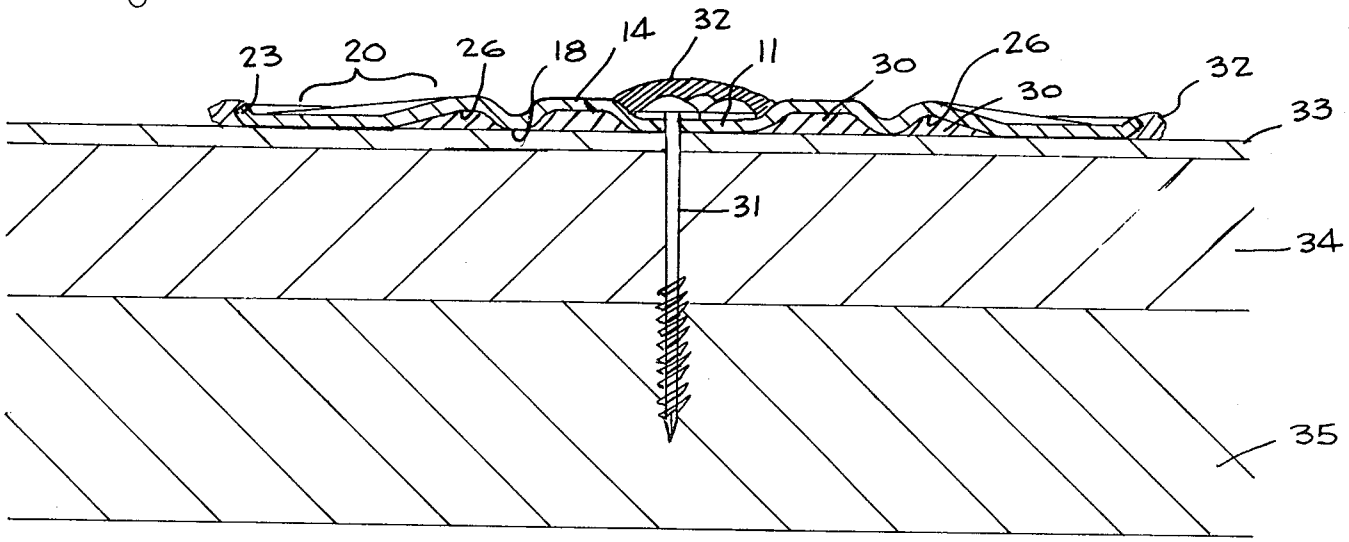
FIG. 6 is a cross-sectional view showing the membrane of FIG. 6 included in an anchor system.

Referring now to FIG. 6, there is shown a membrane anchor system in accordance with the present invention, and utilizing the body 10 shown in FIGS. 1–5. The system of FIG. 6 may, but not necessarily, be utilized where the roof has positive drainage, this being defined as the drainage condition in which consideration has been given for all loading deflections of the deck of the roof, and additional roof slope has been provided to ensure complete drainage of the roof area witin twenty-four hours of rainfall precipitation. In the structure shown in FIG. 6, there is provided a deck substrate 35, over which is an insulating substrate 34. A headed, linear fastener 31 has been passed through the opening 12, and driven into the substrates, one or both, so as to stress and deflect the body 10. A rubber-like flexible and water impervious membrane 33 having been applied over the substrate 34, the contact region 18 and the central region 11 engage the membrane 33, as does the peripheral region 23. Mastic 30 is provided in the cavity 15, and is also provided in the cavities 26 under the outwardly and downwardly sloping region 20. The anchor system of FIG. 6 provides a substantially water impervious mechanical anchoring system for the membrane 33, holding it securely in place while permitting some "creep" or movement thereof to accommodate expansion and contraction. Sealant 32 will be seen to be in place over the head of the fastener 31, in the recess above the central region 11, assuring against penetration of moisture by movement under the head of fastener 31 and along the shank thereof. Additionally, mastic 32 may be applied about the periphery of the body 10, around, over and under the lip 23, so as to ensure against the penetration of moisture beneath the body 10.

In the anchoring system disclosed in FIG. 6, there are provided a multiplicity of bodies 10 and one or more fasteners for each. The bodies 10 may be placed on four foot centers. In that manner, they will securely anchor the underlying membrane, will prevent the entry of moisture which would penetrate the membrane, either beneath the body 10, or along the fasteners, and, in addition, the body 10 will have superior resistance to undesired upward flexing, as by wind forces, due to the provision of the radially extending upwardly convex regions 25, which provide substantial resistance to upward flexing of the outwardly and downwardly extending region.

It will be obvious to those skilled in the art that various changes may be made without departure from the spirit of the invention, and therefore the invention is not limited to that shown in the drawings and described in the specification, but only as indicated in the appended claims.

I claim:

1. In a membrane anchor system in which a roof substrate is covered with a membrane or water impervious material anchored by linear fasteners which penetrate the membrane and are secured to underlying roof structure, a resilient thin disc-like body for engaging said membrane having upper and lower surfaces, said body having an unstressed state and being deformable to a stressed state under load imposed by the linear fastener, and comprising:

(a) a central, substantially planar region, (b) an opening through said body in said central region for a linear fastener, (c) means defining a downwardly facing cavity above said membrane outwardly of and surrounding said central region and said opening, said means in part extending above central region thereby defining in the upper surface a recess above said central region, (d) means defining a groove in surrounding relationship to said cavity defining means, (e) an intermediate region extending outwardly of said groove and having an outer boundary, a peripherally extending flexure zone in said body at said outer boundary, (f) an outer engaging region in surrounding relation to said flexure zone and located at a level below the bottom surface of said groove in the unstressed state of said body, said outer engaging region engaging said membrane in the stressed state of said body, (g) said intermediate region defining therebeneath a mastic overflow cavity outwardly of said groove, and having a bending zone at its inner boundary.

(h) said downwardly sloping region having therein radially extending, upwardly convex regions.

2. The structure of claim 1, and (a) a linear fastener in said opening having a head in said recess, (b) mastic in said cavities and beneath said intermediate region, and (c) sealant over said head in said recess.

3. The structure of claim 1, said central region, said groove and said outer engaging region contacting said membrane.

4. The structure of claim 3, wherein said intermediate region slopes downwardly towards said flexure zone.

5. In a membrane anchor system in which a roof substrate is covered with a membrane of water impervious material anchored by linear fasteners which penetrate the membrane and are secured to underlying roof structure, a resilient thin disc-like body for engaging said membrane having upper and lower surfaces, said body having an unstressed state and being deformable to a stressed state under load imposed by the linear fastener, and comprising:

(a) a central, substantially planar region, (b) an opening through said body in said central region for the linear fastener, (c) means defining a downwardly facing cavity above said membrane outwardly of and surrounding said central region and said opening, (d) an intermediate region outwardly of said cavity defining means and having an outer boundary, a peripherally extending flexure zone in said body at said outer boundary, (e) an outer engaging region in surrounding relation to said flexure zone engaging said membrane, (f) said intermediate region being spaced from said membrane, (g) means between said linear fastener and said outer engaging region in the stressed state of said body for limiting the deformation of said body when in the stressed state thereof, and (h) radially extending, upwardly convex means in said intermediate region for resisting flexure of said intermediate region.

6. In a membrane anchor system in which a roof substrate is covered with a membrane of water impervious material anchored by linear fasteners which penetrate the membrane and are secured to underlying roof structure, a thin disc-like body for engaging said membrane having upper and lower surfaces, and comprising:

(a) a central, substantially planar region, (b) an opening through said body in said central region having the linear fastener passing therethrough, (c) means defining a downwardly facing cavity above said membrane outwardly of and surrounding said region and said opening, (d) an intermediate region outwardly of said cavity defining means and having an outer boundary, (e) an outer engaging region in surrounding relationship to said intermediate region and engaging said membrane, (f) said intermediate region being spaced from said membrane, (g) means between said linear fastener and said outer engaging region and urged against said membrane by said linear fastener, and (h) radially extending, upwardly convex means in said intermediate region for resisting flexure of said intermediate region.

* * * * *